US010858806B2

(12) United States Patent
Ferraz, Jr. et al.

(10) Patent No.: US 10,858,806 B2
(45) Date of Patent: Dec. 8, 2020

(54) MODULAR MANIFOLD HAVING AT LEAST TWO CONTROL MODULES FOR CONTROLLING OPERATION OF AT LEAST TWO HYDRAULIC ACTUATORS OF AN EARTHMOVING MACHINE

(71) Applicant: Caterpillar Inc., Deerfield, IL (US)

(72) Inventors: John Ferraz, Jr., Romeoville, IL (US); Michael Thomas Jackson, Hanna City, IL (US); William Norbert O'Neill, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/299,554

(22) Filed: Mar. 12, 2019

(65) Prior Publication Data

US 2020/0291611 A1 Sep. 17, 2020

(51) Int. Cl.
*E02F 9/22* (2006.01)

(52) U.S. Cl.
CPC ..... *E02F 9/2271* (2013.01); *E02F 9/2267* (2013.01)

(58) Field of Classification Search
CPC ..... F15B 2211/30535; F15B 13/0417; E02F 9/2271; E02F 9/2267
See application file for complete search history.

(56) References Cited

U.S. PATENT DOCUMENTS 5,115,835 A * 5/1992 Ueno ..... E02F 9/2267 137/596.13
5,134,853 A 8/1992 Hirata et al.
5,664,604 A * 9/1997 Sato ..... F15B 13/0817 137/596.16
6,393,838 B1 * 5/2002 Moriya ..... F15B 11/163 60/422
7,240,604 B2 7/2007 Smith et al.
7,921,878 B2 * 4/2011 Coolidge ..... F15B 13/0417 137/625.68
8,833,396 B2 * 9/2014 Kato ..... F15B 13/0842 137/884
9,027,589 B2 * 5/2015 Coolidge ..... F15B 13/026 137/488
9,476,432 B2 * 10/2016 Greenwood ..... F15B 13/021
(Continued)

FOREIGN PATENT DOCUMENTS

CN 203189370 9/2013
CN 108385767 8/2018
(Continued)

*Primary Examiner* — Thomas E Lazo

(57) ABSTRACT

A control module for controlling an operation of a hydraulic actuator that is associated with an earthmoving machine includes a body. The body has a spool chamber and a load sensing passageway associated with the spool chamber. The body also has a spool positioned axially, and at least partially, within the spool chamber. The spool is spring-biased by an end cap located at a first end of the body. The body also has a pair of electrohydraulic spool actuators that are located at a second end of the body and operable to axially displace the spool within the spool chamber. The pair of spool actuators are positioned in parallel and disposed adjacent to one another. The body also has an inlet chamber disposed parallel to the spool chamber and in selective fluid communication with the spool chamber via a spool supply passageway.

18 Claims, 8 Drawing Sheets

(56) References Cited

U.S. PATENT DOCUMENTS

| | | | | |
|---|---|---|---|---|
| 9,631,644 | B2 * | 4/2017 | Huang | F15B 11/006 |
| 9,790,661 | B2 * | 10/2017 | Hand | E02F 3/815 |
| 10,119,558 | B2 * | 11/2018 | Biwersi | F15B 13/0417 |
| 2005/0211320 | A1 | 9/2005 | Greenwood et al. | |
| 2008/0282691 | A1 | 11/2008 | Bulgarelli et al. | |
| 2015/0267720 | A1 | 9/2015 | Huang et al. | |
| 2016/0377098 | A1 * | 12/2016 | Nakamura | F15B 13/0402 137/625.69 |
| 2017/0307096 | A1 * | 10/2017 | Janecke | F16K 17/22 |
| 2017/0314577 | A1 | 11/2017 | Mizukami et al. | |
| 2018/0044891 | A1 | 2/2018 | Cho et al. | |
| 2018/0187396 | A1 * | 7/2018 | Sakamoto | E02F 9/2271 |

FOREIGN PATENT DOCUMENTS

| | | |
|---|---|---|
| JP | 03659549 | 6/2005 |
| KR | 20120072519 | 7/2012 |

* cited by examiner

MODULAR MANIFOLD HAVING AT LEAST TWO CONTROL MODULES FOR CONTROLLING OPERATION OF AT LEAST TWO HYDRAULIC ACTUATORS OF AN EARTHMOVING MACHINE

TECHNICAL FIELD

The present disclosure relates to a control module for controlling operation of a hydraulic actuator associated with an earthmoving machine. More particularly, the present disclosure relates to a modular manifold having at least two control modules for controlling operation of at least two hydraulic actuators of an earthmoving machine.

BACKGROUND

Earthmoving machines typically employ several hydraulic actuators for actuating movement of one or more work implements therein. One example of such an earthmoving machine may include a track-type tractor having a dozing blade and a ripper as the work implements mounted thereon. Such machines may also employ a manifold to help provide a multi-function displacement control, in more than one axis of lever movement by the operator, to move each of the hydraulic actuators for modulating a positioning of the work implements in operation.

An example of such a system is disclosed in U.S. Pat. No. 9,631,644. However, system hardware design of conventional manifold systems, including the system of the '644 patent, may be bulky in construction owing, at least in part, to a sub-optimal positioning of valves and actuators that are used to form the manifold besides continuing to require an increased amount of plumbing for achieving the desired functionality. Consequently, manufacture of such conventional systems may be expensive. Further, an increased amount of space may be required on the machine for installing and operating such conventional systems.

Hence, there is a need for a manifold that overcomes the aforementioned drawbacks.

SUMMARY OF THE DISCLOSURE

In an aspect of the present disclosure, a control module is provided for controlling an operation of a hydraulic actuator that is associated with an earthmoving machine. The control module includes a body. The body has a spool chamber and a load sensing passageway associated with the spool chamber. The body also has a spool positioned axially, and at least partially, within the spool chamber. The spool is spring-biased by an end cap located at a first end of the body. The body also has a pair of electrohydraulic spool actuators that are located at a second end of the body and operable to axially displace the spool within the spool chamber. The pair of spool actuators are positioned in parallel and disposed adjacent to one another. The body also has an inlet chamber disposed parallel to the spool chamber and in selective fluid communication with the spool chamber via a spool supply passageway. The inlet chamber defines an inlet port, and also has a pressure compensating hydrostat and a load check valve. The pressure compensating hydrostat has a valve member that is moveably positioned between a flow blocking position and a flow permitting position to fluid from the inlet port by a fluid pressure differential between the spool supply passageway and the load sensing passageway. The valve member is also biased by a first spring that is located between a first end of the valve member and a first plug disposed at an end port of the inlet chamber. The load check valve is axially biased towards a second end of the valve member by a second spring that is captured between a bearing surface of the load check valve and a second plug located at another end port of the inlet chamber. The other end port of the inlet chamber is disposed in a direction opposite to the first end port of the inlet chamber.

In another aspect of this disclosure, a modular manifold is provided for controlling operation of at least two hydraulic actuators associated with an earthmoving machine. The modular manifold includes at least two control modules corresponding to the at least two hydraulic actuators of the machine. The at least two control modules are adjacently located to one another and coupled to one another in fluid communication. Each control module includes a body. The body has a spool chamber and a load sensing passageway associated with the spool chamber. The body also has a spool positioned axially, and at least partially, within the spool chamber. The spool is spring-biased by an end cap located at a first end of the body. The body also has a pair of electrohydraulic spool actuators that are located at a second end of the body and operable to axially displace the spool within the spool chamber. The pair of spool actuators are positioned in parallel and disposed adjacent to one another. The body also has an inlet chamber disposed parallel to the spool chamber and in selective fluid communication with the spool chamber via a spool supply passageway. The inlet chamber defines an inlet port, and also has a pressure compensating hydrostat and a load check valve. The pressure compensating hydrostat has a valve member that is moveably positioned between a flow blocking position and a flow permitting position to fluid from the inlet port by a fluid pressure differential between the spool supply passageway and the load sensing passageway. The valve member is also biased by a first spring that is located between a first end of the valve member and a first plug disposed at an end port of the inlet chamber. The load check valve is axially biased towards a second end of the valve member by a second spring that is captured between a bearing surface of the load check valve and a second plug located at another end port of the inlet chamber. The other end port of the inlet chamber is disposed in a direction opposite to the first end port of the inlet chamber.

In yet another aspect of this disclosure, a method is provided for controlling at least two hydraulic actuators of an earthmoving machine. The method includes providing at least two control modules such that the at least two control modules have a pair of bodies located adjacent to one another. The method further includes defining, in each body, a spool chamber having a load sensing passageway associated therewith, and an inlet chamber in parallel relation to the spool chamber and in selective fluid communication with the spool chamber via a spool supply passageway. The method further includes providing, in each body, a spool such that the spool is axially, and at least partially, positioned within the spool chamber, an end cap at a first end of each body such that the end cap has a spring to bias the spool away from the end cap, and a pair of electrohydraulic spool actuators at a second end of each body such that the pair of spool actuators are positioned in parallel and disposed adjacent to one another. The method further includes defining, in each body, an inlet port such that the inlet port is in fluid communication with the spool supply passageway, a first and second outlet port such that the first and second outlet ports are in selective and independent fluid communication with the spool chamber based on a position of the spool within the spool chamber, and a pilot supply port and a pilot discharge port such that the pilot supply and discharge ports are in fluid communication with the pair of electrohydraulic spool actuators via a pilot supply line and a pilot discharge line respectively.

Other features and aspects of this disclosure will be apparent from the following description and the accompanying drawings.

DETAILED DESCRIPTION

Figure 1:
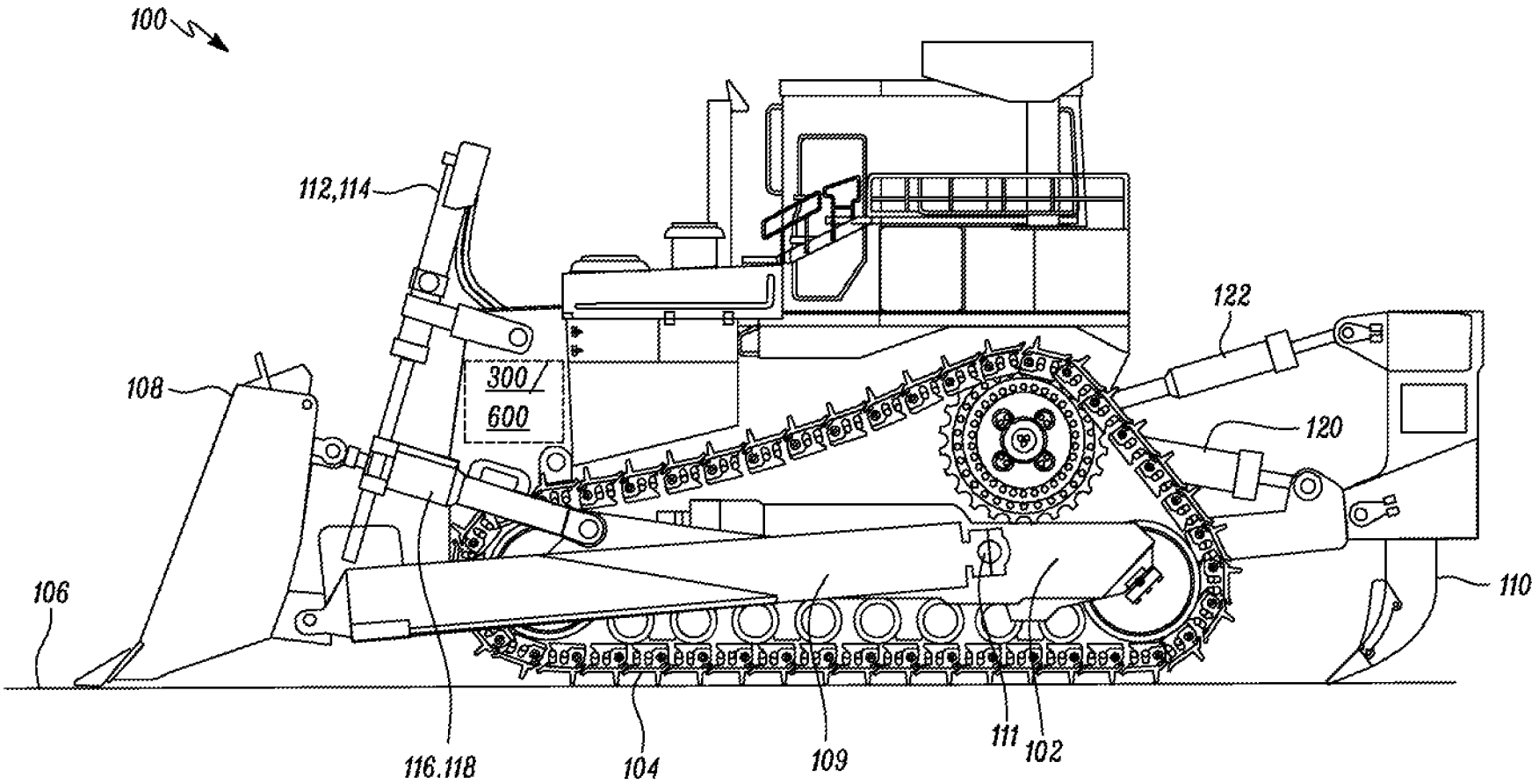
FIG. 1 is a diagrammatic view of an exemplary earthmoving machine having a first work implement, a second work implement, and hydraulic actuators for controlling movement of the first work implement and the second work implement respectively, in accordance with an exemplary embodiment of the present disclosure.

Reference numerals appearing in more than one figure indicate the same or corresponding parts in each of them. References to elements in the singular may also be construed to relate to the plural and vice-versa without limiting the scope of the disclosure to the exact number or type of such elements unless set forth explicitly in the appended claims.

FIG. 1 illustrates an exemplary earthmoving machine 100, hereinafter referred to as 'the machine 100'. As shown, the machine 100 is embodied as a tractor. However, in other embodiments, the machine 100 may embody other forms or types of earthmoving machines known to persons skilled in the art.

The machine 100 includes a frame 102, and a pair of ground engaging members 104 rotatably supported on the frame 102. Although, only one ground engaging member 104 is visible in the side view of FIG. 1, a similar ground engaging member is present on the machine 100 and is located distally away from the ground engaging member 104 visible in the view of FIG. 1. The ground engaging members 104 may rotate relative to the frame 102 for propelling the machine 100 on a work surface 106, for example, a mine site. As shown, the pair of ground engaging members 104 may include tracks. However, persons skilled in the art will acknowledge that the present disclosure is not limited to a type of ground engaging members 104 i.e., the tracks disclosed herein. Other types of ground engaging members, for example, wheels may be used to form the ground engaging members 104 in lieu of the tracks disclosed herein.

The machine 100 may include a first work implement 108 that is moveably supported on a fore portion of the frame 102. As shown, one end of a push arm 109 is coupled to the frame 102 using a pivot joint 111 and another end of the push arm 109 pivotally supports movement of the work implement 108 thereon. Further, as shown in the view of FIG. 1, the first work implement 108 is embodied as a carry-dozing blade, and for sake of simplicity, the first work implement 108 will hereinafter be referred to as 'the blade 108'.

Figure 2:
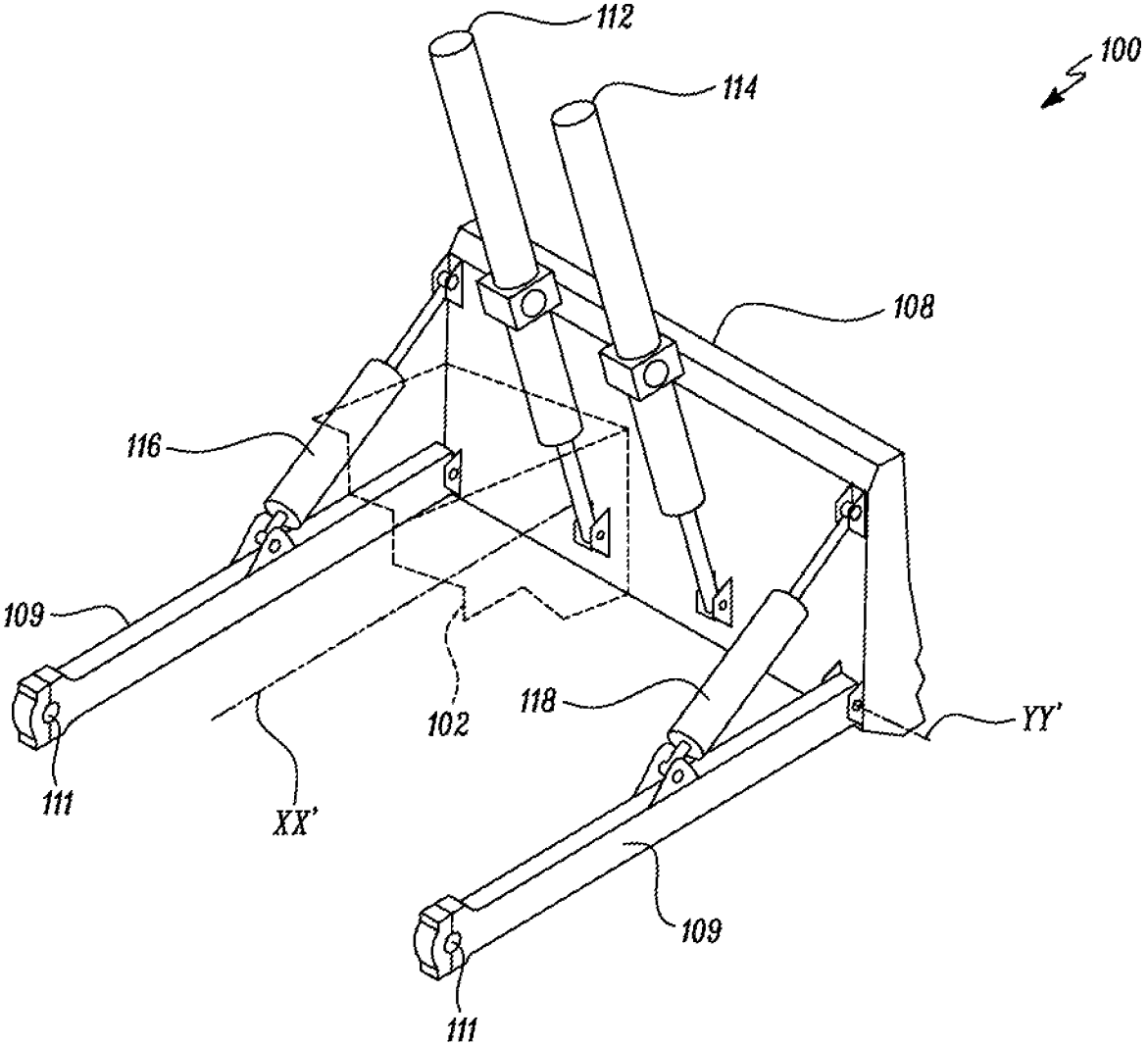
FIG. 2 shows a rear perspective view of the exemplary first work implement that is controlled by independent operation of two tilt actuators and two lift actuators of the machine, in accordance with an exemplary embodiment of the present disclosure.

With continued reference to FIG. 1 and as shown best in the view of FIG. 2, the machine 100 includes a pair of hydraulic lift actuators 112, 114 hereinafter referred to as 'the lift actuator/s 112, 114', that are supported by the frame 102 and connected to a rearwardly facing mid-portion of the blade 108. The lift actuators 112, 114 operably raise or lower the blade 108 in relation to the work surface 106. Further, the machine 100 also includes a pair of hydraulic tilt actuators 116, 118, hereinafter referred to as 'tilt actuator/s 116, 118', that are disposed on opposite sides of the machine 100 and located between the push arms 109 and the blade 108 for tilting and/or tipping the blade 108 relative to the frame 102.

Additionally, or optionally, as shown, the machine 100 further includes another work implement i.e., a second work implement 110 moveably supported on a rear portion of the frame 102. As shown in the illustrated embodiment of FIG. 1, the second work implement 110 is embodied as a ripper, and for sake of convenience, the second work implement 110 will hereinafter be referred to as 'the ripper 110'. Furthermore, the machine 100 also includes a pair of ripper lift actuators 120 and a pair of ripper tilt actuators 122, each of which are disposed on opposite sides of the machine 100 and supported by the frame 102. The ripper lift actuators 120 are configured to operably lift i.e., raise or lower the ripper 110 relative to the frame 102, or stated differently, relative to the work surface 106. The ripper tilt actuators 122 are configured to operably change an angle of attack of the ripper 110 relative to the work surface 106, or stated differently, change an axis of the ripper 110 relative to the frame 102.

In this application, 'tilting' of the blade 108 is the action of moving the blade 108 about a horizontally arranged longitudinal axis XX' (refer to FIG. 2) that is substantially perpendicular to the blade 108, whereas 'tipping' of the blade 108 is the action of moving the blade 108 about a horizontally arranged transverse axis YY' that is substantially parallel to the blade 108. However, in the context of the second work implement i.e., the ripper 110, the terms 'tilt' and 'lift' are representative of an angular orientation and a height of the ripper 110 respectively with respect to the frame 102 of the machine 100 or the work surface 106. Moreover, although one configuration of the lift actuators 112, 114, the tilt actuators 116, 118, and the ripper lift and tilt actuators 120, 122 is disclosed herein, persons skilled in the art will acknowledge that embodiments of the present disclosure may be similarly applied to other types of machines in which alternative configurations of the lift actuators 112, 114, the tilt actuators 116, 118, and/or the ripper lift and tilt actuators 120, 122 may be contemplated for use in controlling movement of one or more work implements relative to the frame 102.

In addition to the aforementioned functions, advanced functionality may be associated with one or both work implements 108, 110, for instance, the blade 108. The present disclosure discloses, in part, specific hydraulic control hardware design that can operationally support fluid delivery demands by one or more actuators, for example, during a typical regeneration event in which quicker movement of lift and/or tilt hydraulic actuators may be needed, or when the blade 108 is required to be set into a float condition in which the blade 108 is subject to the influence of gravity alone and due to which the blade 108, loaded or without load thereon, would typically come to rest on the work surface 106. Therefore, it will be appreciated that the specific hydraulic control hardware disclosed herein is intended to support these, amongst other advanced functionality of the work implements 108, 110 that are commonly known to persons skilled in the art.

Figure 3:
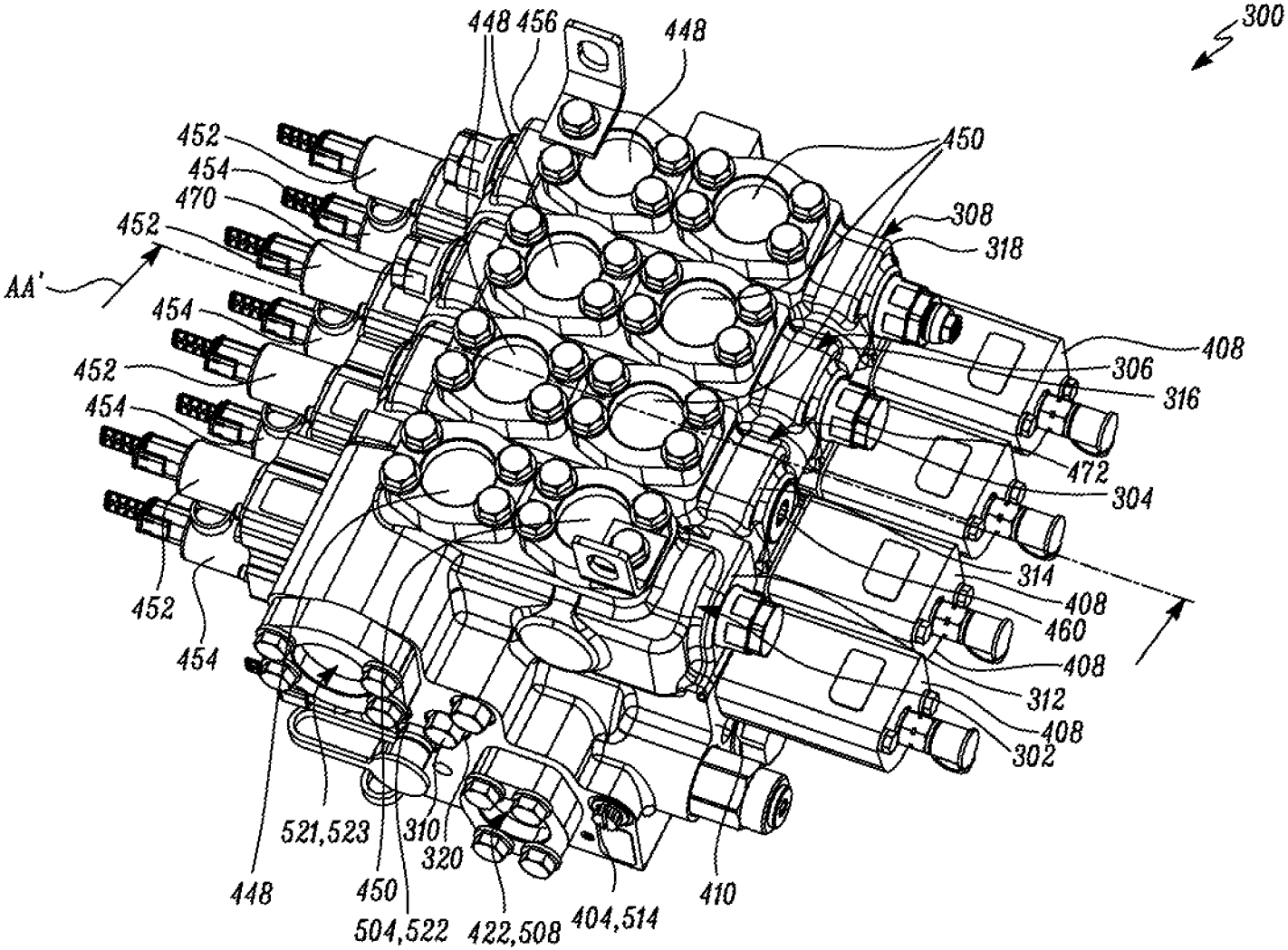
FIGS. 3, 4, and 5 are perspective, cross-sectional, and schematic representations of a modular manifold showing four control modules that are setup for controlling movement of the hydraulic actuators associated with the pair of work implements, in accordance with an embodiment of the present disclosure.
Figure 5:
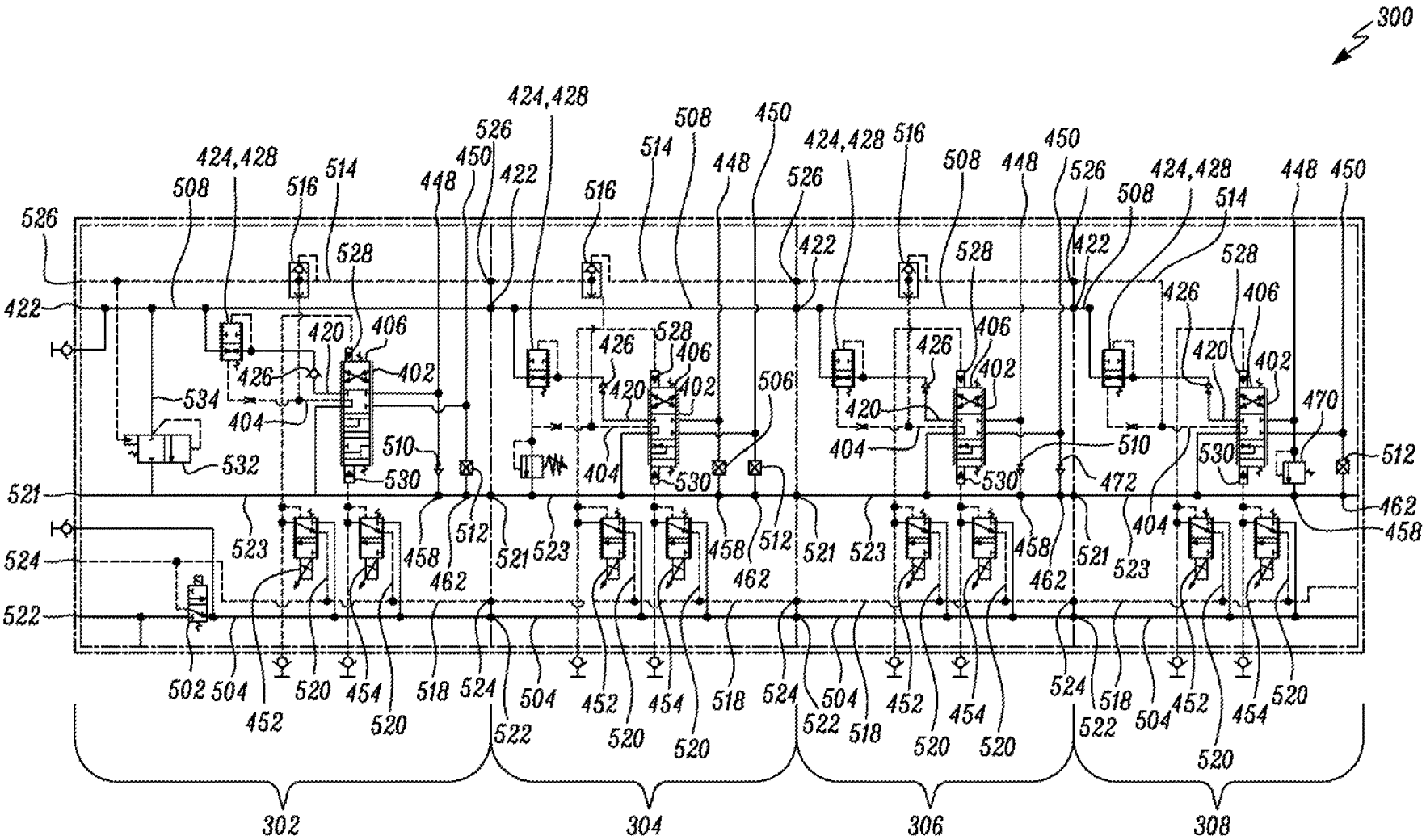
Figure 7:
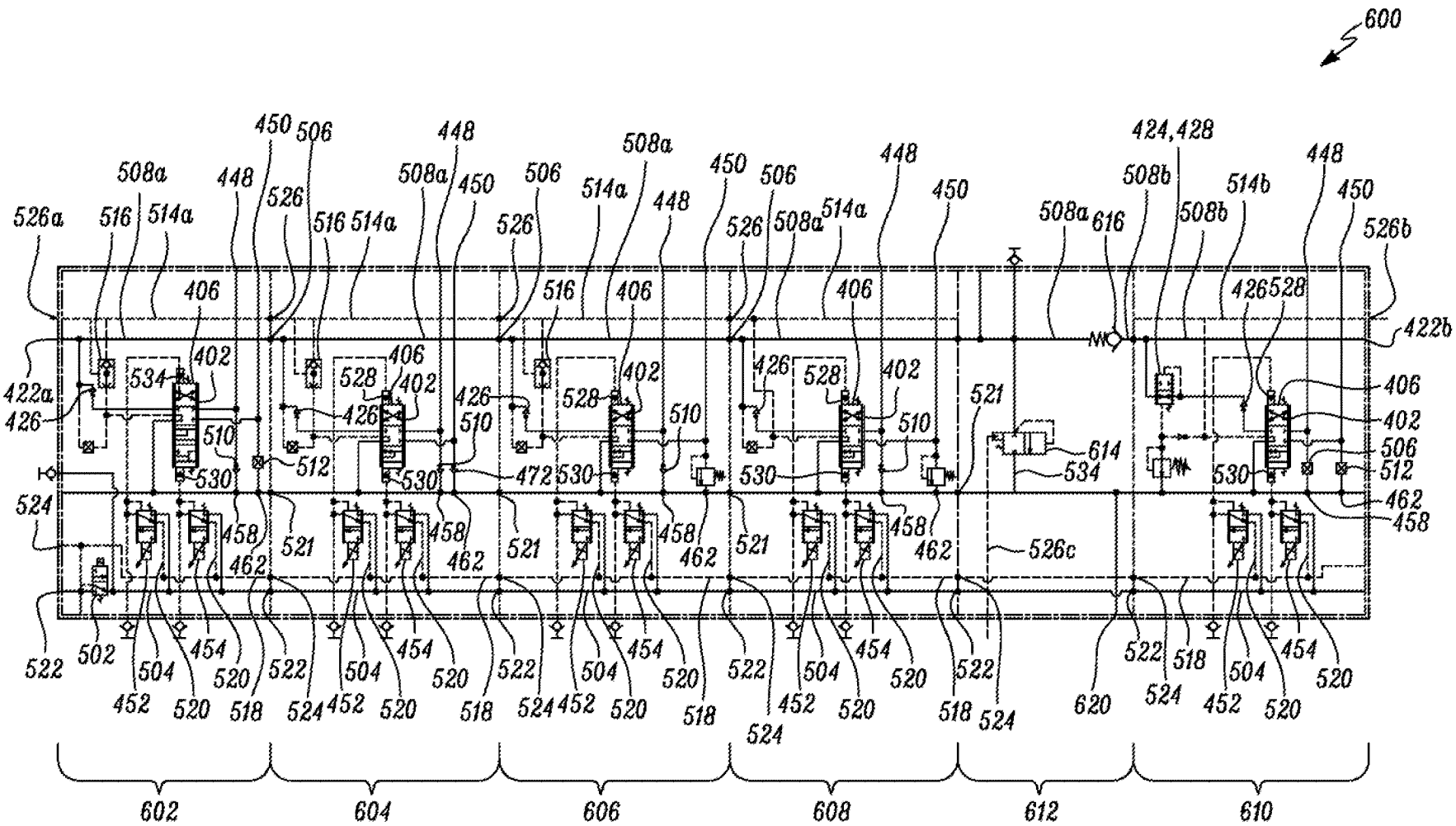

With continued reference to FIG. 1, a modular manifold 300 or 600 is provided to the machine 100 and is shown schematically in FIGS. 5 and 7 respectively, in accordance with embodiments of the present disclosure. Referring to FIGS. 3 and 5, the modular manifold 300 includes four control modules 302, 304, 306 and 308 that correspond to the eight hydraulic actuators 112-122 of the machine 100. The control modules 302, 304, 306, and 308 are configured to control operation of the lift actuators 112, 114, the tilt actuators 116, 118, the ripper lift actuators 120, and the ripper tilt actuators 122 respectively. Although explanation will now be made in reference to the modular manifold 300, similar explanation will be applicable to the manifold 600 unless wherever expressly differentiated in this disclosure.

In embodiments herein, the control modules 302, 304, 306, and 308 are successively located adjacent to one another. Further, bodies of the individual control modules 302, 304, 306, and 308 are releasably secured using one or more fasteners 310, for example, HEX bolts received, with or without fluid scaling mechanisms, within one or more mounting through-holes 320 defined on the bodies 312-318 of the control modules 302, 304, 306, and 308. Furthermore, upon securement, the adjacently located control modules 302, 304, 306, and 308 are coupled in fluid communication with one another, via mutually aligned ports as will be explained later herein, to facilitate a sharing of fluid flow between the individual control modules 302, 304, 306 and 308 with each control module 302, 304, 306, and 308 present in the manifold 300 being adapted to deliver fluid with optimally specific pressure/s based on application requirements, for instance, the dynamically changing load conditions on the actuators associated with the work implements 108, 110, or in other words, the dynamically changing hydraulic load on a fluid transmission system (not shown) of the machine 100, for example, a variable displacement pump and/or other hydraulic circuits of the machine 100 that may be coupled in communication with the manifold 300. These adaptations may be specific to individual control modules 302, 304, 306, and 308 respectively, as will be explained later herein. However, it is to be noted that such adaptations should not be construed as being limiting of this disclosure. Rather, it should be appreciated that such adaptations may provide flexibility to use a stack of control modules, for instance, the control modules 302, 304, 306 and 308 to form the unitary yet modular manifold 300 that facilitates a sharing of fluid flow between the individual control modules 302, 304, 306 and 308 in turn allowing the individual control modules 302, 304, 306 and 308 of the manifold 300 to support simultaneously the varying load demands of each of the hydraulic actuators 112-122 present on the machine 100.

Figure 4:
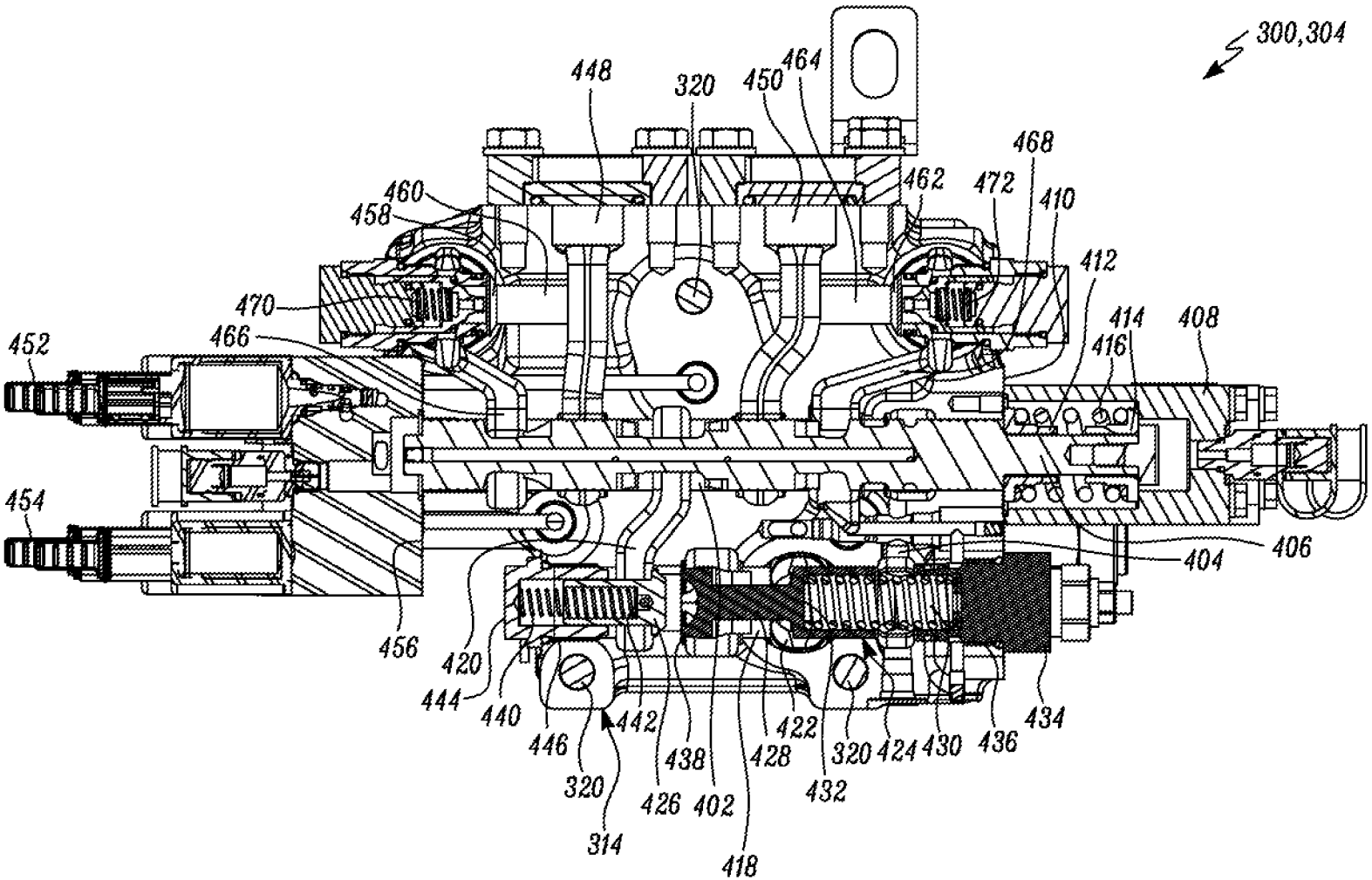

FIG. 4 depicts a cross-sectional view of the modular manifold 300, and in particular of the control module 304, as taken along the sectional plane AA' of FIG. 3, and FIG. 5 depicts a schematic of the modular manifold 300. For sake of simplicity, explanation will hereinafter be made in conjunction with the control module 304 of the modular manifold 300. However, it should be noted that such explanation is similarly applicable to the other three control modules 302, 306, and 308 of the manifold 300, unless expressly differentiated herein.

As shown in FIG. 4, the body 314 has a spool chamber 402 and a load sensing passageway 404 associated with the spool chamber 402. The body 314 also has a spool 406 positioned axially, and at least partially, within the spool chamber 402. The spool 406 is spring-biased by an end cap 408 located at a first end 410 of the body 314. Further, in an embodiment as shown, a stroke i.e., a travel distance of the spool 406 may be defined by one or more stop members, for example, two stop members 412,414 that are exemplarily shown positioned within the end cap 408. Furthermore, as shown in this embodiment, a spring 416 is located within the end cap 408 and positioned between the pair of stop members 412, 414, for biasing the spool 406 away from the end cap 408.

The body 314 also has an inlet chamber 418 that is located parallel to the spool 406 and disposed in selective fluid communication with the spool 406 via a spool supply passageway 420. The inlet chamber 418 of the body 314 defines an inlet port 422, and has a pressure compensating hydrostat 424 and a load check valve 426 associated therewith. The hydrostat 424 may be implemented by way of a screw-in cartridge type valve assembly, or a slip-in cartridge type valve assembly as shown. The hydrostat 424 has a valve member 428 that is moveably positioned between a flow blocking position and a flow permitting position to fluid at the inlet chamber 418 by a fluid pressure differential between the spool supply passageway 420 and the load sensing passageway 404.

The valve member 428 is biased by a first spring 430 that is located between a first end 432 of the valve member 428 and a first plug 434 disposed at an end port 436 of the inlet chamber 418. The load check valve 426 is axially biased towards a second end 438 of the valve member 428 by a second spring 440 that is captured between a bearing surface 442 of the load check valve 426 and a second plug 444 located at another end port 446 of the inlet chamber 418. As shown, the other end port 446 of the inlet chamber 418 is disposed in a direction opposite to the end port 436 of the inlet chamber 418.

Further, the body 314 has a first outlet port 448 and a second outlet port 450 that are disposed in selective and independent fluid communication with the spool supply passageway 420, via the spool chamber 402, based on a position of the spool 406 within the spool chamber 402. In some embodiments, the first and second outlet ports 448, 450 may be configured to selectively communicate fluid from the spool supply passageway 420 to a head end chamber and a rod end chamber (not shown) of a hydraulic actuator respectively. In other embodiments, the first and second outlet ports 448, 450 may be configured to selectively communicate fluid from the spool supply passageway 420 to an additional valve assembly (not shown) that is associated with one of the hydraulic actuators. For example, the first and second outlet ports 448,450 of the control modules 306, 308 may connect with the head end and rod end chambers of the ripper lift actuators 120 and the ripper tilt actuators 122, while the first and second outlet ports 448, 450 of the control modules 302, 304 may connect with a quick drop valve and a regeneration valve (not shown) that are associated with the lift actuators 112, 114 and the tilt actuators 116, 118 of the machine 100 respectively.

The body 314 also has a pair of electrohydraulic spool actuators 452, 454 that are located at a second end 456 of the body 314 and operable to axially displace the spool 406 within the spool chamber 402. The pair of spool actuators 452, 454 are positioned in parallel and disposed adjacent to one another. In embodiments herein, the pair of spool actuators 452, 454 may be embodied as proportional solenoid control valves. Therefore, for sake of the present disclosure, the spool 406 may be regarded as a proportional directional spring-centered 3-way or 4-way control valve depending upon the specific hardware design of each control module 302, 304, 306, and 308 respectively. For instance, as shown in FIG. 5, the spool 406 used in the control module 302 is embodied as a 4-way directional control valve while the spool 406*s* used in respective ones of the control modules 304, 306, and 308 may embody the 3-way directional control valve. Although the spool 406 associated with the bodies 312-318 of the control modules 302, 304, 306, and 308 is disclosed herein as a 3-way or 4-way directional control valve, persons skilled in the art can contemplate implementing other configurations of the spool 406 depending on one or more fluid delivery requirements that are associated with each hydraulic actuator 112-122 of the machine 100.

Further, in embodiments herein, the hydrostat 424 may be a slip-in type cartridge valve assembly that may be readily available for installation within the body 314 of the control module 302 as shown in the view of FIG. 4. Although a slip-in type cartridge type valve assembly is disclosed herein, it may be noted that a manner of installation for the pressure compensating hydrostat 424 within the inlet chamber 418 of the body 314 of the control module 302 is exemplary in nature and hence, should not be construed as being limiting of this disclosure. Other types of valve assemblies such as a screw-in type cartridge valve assembly may be used to implement the hydrostat 424 in lieu of the slip-in type cartridge valve assembly disclosed herein.

The body 314 also has a first port 458 in fluid communication with the first outlet port 448 via a first passageway 460, and a second port 462 in fluid communication with the second outlet port 450 via a second passageway 464. Further, the first port 458 is in selective fluid communication with the spool 406 via a third passageway 466, and the second port 462 is in selective fluid communication with the spool 406 via a fourth passageway 468. Also, in embodiments herein, the load sensing passageway 404 may be disposed in selective and independent fluid communication with one of the third and fourth passageways 466, 468. The load sensing passageway 404 is configured to generate a fluid pressure signal to bias the first end 432 of the valve member 428 away from the first end 410 of the body 314 so as to regulate a flow of fluid from the inlet port 422 to the inlet chamber 418, for instance, when transient loading conditions occur at the head end chamber or the rod end chamber of the actuator, for instance, the ripper tilt actuator 122.

In embodiments herein, each control module 302, 304, 306, and 308 may further include at least one of a first check valve 510, a first pilot-operated relief valve 470, and a third plug 506 disposed in the first port 458 of the body 314. For example, as shown in the schematic of FIG. 5, the first check valve 510 may be disposed in the first port 458 of each of the control modules 302, 306, the third plug 506 may be disposed in the first port 458 of the control module 304, and the first pilot-operated relief valve 470 may be disposed in the first port 458 of the control module 308. Further, in embodiments herein, each control module 302, 304, 306, and 308 may also include one of a second check valve 472 and a fourth plug 512 disposed in the second ports 462 of the bodies 312-318 from corresponding ones of the control modules 302-308 respectively. For example, as shown in the schematic of FIG. 5, the fourth plug 512 may be disposed in the second port 462 of each of the control modules 302, 304, and 308, and the second check valve 472 may be disposed in the second port 462 of the control module 308.

Moreover, as shown in the schematic of FIG. 5, the body 312-318 of one of the control modules 302, 304, 306, and 308, for instance, the body 312 of the control module 302 may be configured differently from the body 314 of the control module 304 in that the body 312 of the control module 302 may be configured to house an electrohydraulic pilot supply valve 502 therein. In operation, the pilot supply valve 502 may be energized to allow a pilot supply of fluid from a fluid source, for example, a pump (not shown) via a pilot supply line 504 into one or both spool actuation lines associated with the pair of electrohydraulic spool actuators 452, 454. Based on the energization of the first spool actuator 452 and/or the second spool actuator 454 from the pair of electrohydraulic spool actuators 452, 454, one or both end actuators 528, 530 associated with the spool 406 i.e., the proportional control valve can cause the spool 406 to move into one of many pr-defined positions of the spool 406 with respect to the spool chamber 402 for allowing fluid from the fluid source i.e., the pump to be routed via the pump supply line 508 so as to cause, or prevent, displacement of the actuator based on an inter-relative positioning of the spool 406 with the spool chamber 402.

Further, as shown in the schematic of FIG. 5, upon coupling the control modules 302, 304, 306 and 308, the manifold 300 may define a pilot discharge line 518 in fluid communication with the pilot discharge port 524. The pilot discharge line 518 is configured to return pilot actuation fluid from the end actuators 528, 530 of the spool 406, via the pair of spool actuators 452, 454 and the associated pilot discharge passageways 520, to the pilot discharge port 524 when one or both spool actuators 452, 454 are de-energized.

Furthermore, as best shown in the schematic of FIG. 5, upon coupling the control modules 302, 304, 306 and 308, the manifold 300 defines a pump supply line 508 in fluid communication with the inlet port 422 of each control module 302, 304, 306 and 308. The pump supply line 508 may be disposed in selective fluid communication with the spool chamber 402 via the valve member 428 of the hydrostat 424 which is depicted schematically as a two-position pilot-operated inlet valve. Furthermore, as shown, the inlet valve 428 is configured in selectively communicate fluid from the pump supply line 508 to the load check valve 426 located downstream of the inlet valve 428.

As shown in the view of FIG. 5, each control module 302, 304, 306 and 308 has a drain port 521 that is disposed in selective fluid communication with the first port 458 and the second port 462 via a drain line 523. The drain port 521 is also disposed in selective fluid communication with the inlet port 422 via a pressure relief passageway 534 having a pilot-operated main pressure relief valve 532 disposed therein. The pilot-operated main pressure relief valve 532 is configured to bleed fluid from the inlet port 422 to the drain port 521, via the pump supply line 508 and the pressure relief passageway 534, based on a pump supply pressure at the inlet port 422 exceeding a load pressure signal.

Further, the manifold 300 also includes a load sensing line 514 that is in selective fluid communication with the load sensing passageway 404 via a bi-directional pilot-operated shuttle valve 516. Moreover, as shown, the load sensing passageway 404 associated with the spool 406 is also fluidly coupled to the hydrostat 424 i.e., the two-position pilot operated inlet valve 428. Therefore, in embodiments herein, the load pressure signal is provided by the load sensing passageway 404 to the pump, via the shuttle valve 516 and the load sensing line 514, and the hydrostat 424 for varying a pump displacement, and for varying the flow rate of fluid from the inlet valve 428 into the inlet chamber 418 of the control modules 304 respectively.

In operation, when a pressure in the spool chamber 402 increases from operation of one of the spool actuators 452,454, a corresponding increase in pressure, proportional to the increase in pressure of the spool chamber 402, occurs in the load sensing passageway 404 of the control module 304. This increase in pressure of the load sensing passageway 404 acts on the first end 432 of the valve member 428 of the hydrostat 424 to cause movement of the valve member 428 towards a flow blocking position with respect to the body 314 of the control module 304 i.e., to restrict flow of fluid between the inlet chamber 418 and the spool supply passageway 420 (refer to FIG. 4).

Also, with continued reference to FIG. 4, it may be noted that when the net force on the valve member 428 equals zero i.e., the pressure differential between the first and second ends 432, 438 of the valve member 428 is zero, the valve member 428 moves to a flow permitting position for allowing fluid flow from the inlet chamber 418 to an intermediate chamber 419 located between the valve member 428 and the load check valve 426. Based on a pressure of the fluid between the valve member 428 and the load check valve 426 (i.e., the pressure of fluid in the intermediate chamber 419) overcoming the biasing force of the second spring 440 of the load check valve 426, the load check valve 326 may open to route fluid from the intermediate chamber 419 to the spool chamber 402 via the spool supply passageway 420.

In embodiments herein, it may be noted that the mounting through-holes 320 from the bodies 312-318 of respective ones of the control modules 302, 304, 306, and 308 are in axial alignment to correspond with one another for facilitating insertion of the fasteners 310 therein. Further, the inlet ports 422, the drain ports 521, the pilot supply ports 522, the pilot discharge ports 524, and the load sensing ports 526 from individual control modules 302, 304, 306, and 308 are also in axial alignment to correspond with one another so that upon securing the bodies 312-318 of respective control modules 302, 304, 306, and 308, the inlet ports 422, the drain ports 521, the pilot supply ports 522, the pilot discharge ports 524, and the load sensing ports 526 from individual control modules 302, 304,306, and 308 can communicate fluid with the inlet ports 422, the drain ports 521, the pilot supply ports 522, the pilot discharge ports 524, and the load sensing ports 526 from adjacently located control modules 302, 304, 306, and 308 via the pump supply line 508, the drain line 523, the pilot supply line 504, the pilot discharge line 518, and the load sensing line 514 respectively.

Figure 6:
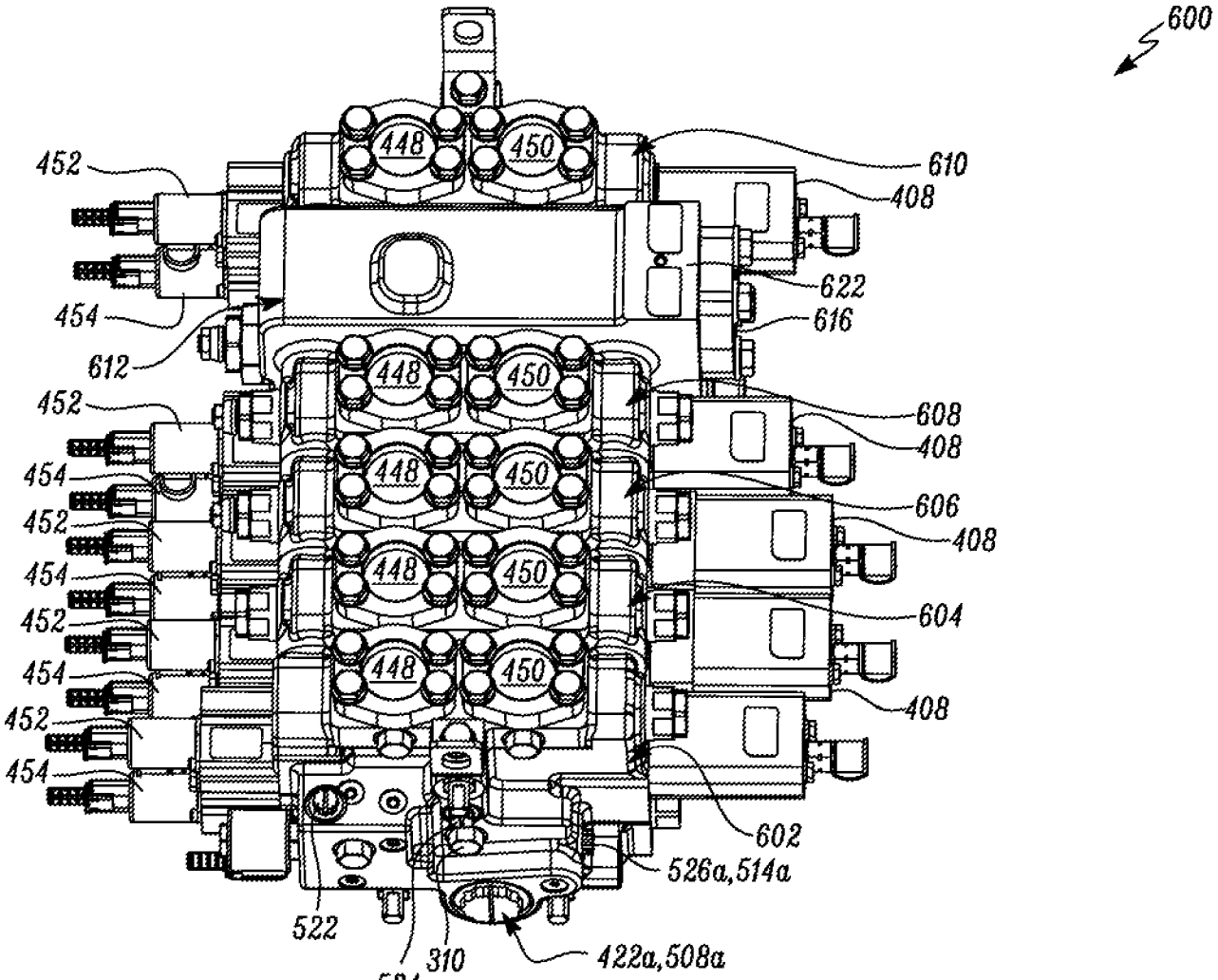
FIGS. 6-7 are perspective and schematic representations of a modular manifold having five control modules for controlling movement of the hydraulic actuators associated with the pair of work implements, in accordance with another embodiment of the present disclosure.

Referring to FIGS. 6-7, a perspective view and schematic of the modular manifold 600 is depicted, in accordance with another embodiment of the present disclosure. As illustrated in the embodiment of FIGS. 6 and 7, the modular manifold 600 includes five control modules 602, 604, 606, 608 and 610, and one pressure relief module 612 that is positioned between the control modules 608 and 610 and in fluid communication with the stack of control modules 602-608 and the control module 610 respectively. In this embodiment, the individual control modules 602 and 608 correspond with both the lift actuators 112, 114 present on the machine 100 while the control modules 604, 606, and 610 correspond to the ripper lift actuators 120, the ripper tilt actuators 122, and the pair of tilt actuators 116, 118 respectively. The configuration of the manifold 600, that is, the two control modules 602 and 608 of the manifold 600 in particular, may be implemented for use in controlling one pair of hydraulic actuators i.e., in this case, the lift actuators 112, 114 in scenarios where the machine 100 is of a larger-than-usual size. For example, a large tractor that typically operates with greater fluid delivery demands when compared to conventionally sized tractors. Therefore, it will be appreciated that in embodiments herein, two or more control modules may be provided to correspond with a pair of hydraulic actuators having the same function, for example, the pair of lift actuators 112, 114 as disclosed in reference to the schematic of FIG. 7.

Further, in this embodiment, bodies of the individual control modules 602, 604, 606, 608 and 610 are configured to define the inlet ports 422, the drain ports 521, the pilot supply ports 522, the pilot discharge ports 524, and the load sensing ports 526. However, owing to the greater fluid delivery demands when the machine 100 is of a larger-than-usual size machine, the distally located inlet ports 422 from the pair of control modules 602 and 610, denoted by alpha-numerals 422*a* and 422*b* respectively, may be used provide fluid flow from a pair of pumps (not shown) into the pump supply lines 508*a* and 508*b* respectively. Further, as shown, the pressure relief module 612 includes a check valve 616 that allows fluid from one of the two pumps i.e., the pump connected via the inlet port 422*b* to supply the pump supply line 508*a*, via the pump supply line 508*b*, with additional flow of fluid when conditions of increased load demands are experienced by the manifold 600.

As shown in the illustrated embodiment of FIG. 7, a first load sensing line 514*a* from the stack of control modules 602-608 located on one side of the pressure relief module 612 is configured to terminate at the pressure relief module 612. This first load sensing line 514*a* has a first load sensing port 526*a* defined at the distally located control module 602. Also, the control module 610 has a second load sensing port 526*b* in communication with a second load sensing line 514*b* that is also configured to terminate at the pressure relief module 612. Further, the pressure relief module 612 defines a pressure relief passageway 534 having a pilot-operated pressure relief valve 614 disposed therein. Furthermore, the pilot-operated main relief valve 614 is configured to selectively communicate bleed off excess fluid from the pump supply lines 508*a* and/or 508*b* via the drain ports 521 and a main drain port 620 of the pressure relief module 612 when the pump supply pressure exceeds the load pressure signal of the stack of control modules 602-608 and/or the control module 610.

As such, in this embodiment, the pressure relief module 612 may be configured to define a third load sensing passageway 526*c* that, together with the first and second load sensing ports 526*a*, 526*b*, co-operatively provides a cumulative load pressure signal to the pair of pumps for varying their respective displacements. This configuration of the first, second, and third load sensing ports 526*a*, 526*b*, and 526*c* may improve a system response of the manifold 600 to dynamically changing loads associated with the hydraulic actuators 112-122 of the machine 100.

Also, in this embodiment, the pressure compensated hydrostat 424 has been omitted from the stack of control modules 602, 604, 606, 608 and 610 and only one control module i.e., the control module 610 has the pressure compensated hydrostat 424 disposed therein. Further, the bi-directional shuttle valve 516 is associated with only three control modules i.e., the control modules 602, 604, and 606 of the manifold 600 while the load check valves 426 are associated with each of the control modules 602, 604, 606, 608 and 610 present in the manifold 600. It may be noted that in embodiments herein, the bi-directional shuttle valve 516, the pressure compensating hydrostat 424, and the load check valve 426 may be selectively disposed in each of the control modules 602, 604, 606, 608 and 610 based on a fluid metering requirements associated with corresponding ones of the hydraulic actuators i.e., the lift actuators 112, 114, the tilt actuators 116, 118, the ripper lift actuators 120, and the ripper tilt actuators 122 respectively.

In embodiments herein, it may be noted that a controller may be associated with the manifolds of the present disclosure. The controller may be a stand-alone controller or may be configured to co-operate with an existing electronic control unit (ECU) (not shown) of the machine 100. Further, the controller 376 may embody a single microprocessor or multiple microprocessors. Numerous commercially available microprocessors can be configured to perform the functions of the controller 376 disclosed herein. It should be appreciated that the controller 376 could readily be embodied in a general machine microprocessor capable of controlling numerous machine functions. The controller 376 may also include a memory and any other components for running an application. Various circuits may be associated with the controller 376 such as power supply circuitry, signal conditioning circuitry, solenoid driver circuitry, and other types of circuitry. Also, various routines, algorithms, and/or programs can be stored at the controller 376 for controlling an operation of the pilot supply valve 502 and the pair of spool actuators 452, 454 for controlling movement and/or positioning of the work implements 108, 110 relative to the frame 102 or the work surface 106 based, at least in part on, for example, a current position of the work implements 108, 110 as sensed and output by one or more position sensors (not shown) associated therewith.

Figure 8:
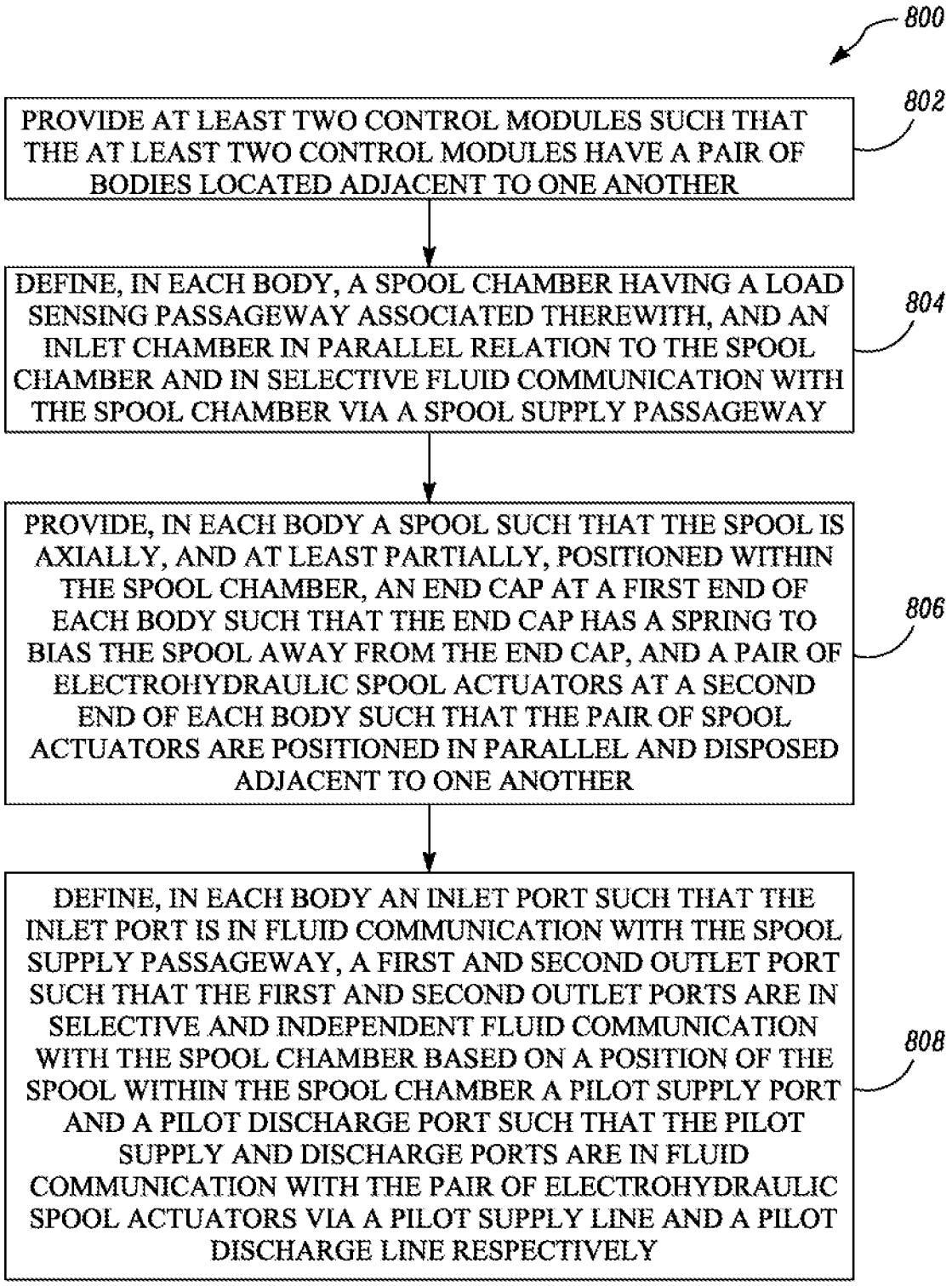
FIG. 8 is a flowchart depicting steps of a method for controlling at least two hydraulic actuators of the earthmoving machine, in accordance with an embodiment of the present disclosure.

FIG. 8 illustrates a method 800 for controlling at least two hydraulic actuators 112-122 of the earthmoving machine 100, in accordance with embodiments of the present disclosure. Although the method 800 is disclosed in reference to the manifold 300 of FIGS. 3-5, the method 800 may be similarly applicable for producing the manifold 600 without deviating from spirit of the present disclosure. As shown at step 802 of FIG. 8, the method 800 includes providing at least two control modules i.e., the control modules 302-308 such that the at least two control modules 302-308 have a pair of bodies located adjacent to one another. At step 804, the method 800 further includes defining, in each body 312-318, the spool chamber 402 having the load sensing passageway 404 associated therewith, and the inlet chamber 418 in parallel relation to the spool chamber 402 and in selective fluid communication with the spool 406 via the spool supply passageway 420.

At step 806, the method 800 further includes providing, in each body 312-318, the spool 406 such that the spool 406 is axially, and at least partially, positioned within the spool chamber 402, the end cap 408 at the first end 410 of each body 312-318 such that the end cap 408 has the spring 416 to bias the spool 406 away from the end cap 408, and the pair of electrohydraulic spool actuators 452, 454 at the second end of each body 312-318 such that the pair of spool actuators 452, 454 are positioned in parallel and disposed adjacent to one another.

At step 808, the method 800 further includes defining, in each body 312-318, the inlet port 422 such that the inlet port 422 is in fluid communication with the spool supply passageway 420, the first and second outlet ports 448, 450 such that the first and second outlet ports 448, 450 are in selective and independent fluid communication with the spool chamber 402 based on a position of the spool 406 within the spool chamber 402, and the pilot supply and discharge ports 522, 524 such that the pilot supply and discharge ports 522, 524 are in fluid communication with the pair of electrohydraulic spool actuators 452, 454 via the pilot supply line 504 and the pilot discharge line 518 respectively.

Additionally, in embodiments herein, the method 800 also includes defining, in each body 312-318, the first port 458 such that the first port 458 is in fluid communication with the first outlet port 448 via the first passageway 460 and in selective fluid communication with the spool chamber 402 via the third passageway 466, and the second port 462 such that the second port 462 is in fluid communication with the second outlet port 450 via the second passageway 464 and in selective fluid communication with the spool chamber 402 via the fourth passageway 468. Further, the method 800 also includes defining the load sensing passageway 404 within each body 312-318 such that the load sensing passageway 404 is in selective and independent fluid communication with each of the third and fourth passageways 466, 468.

Furthermore, in embodiments herein, the method 800 also includes defining, in each body 312-318, the drain port 521 such that the drain port 521 is in selective fluid communication with the first and second ports 458, 462 via the drain line 523, and also in selective fluid communication with the inlet port 422 via the pressure relief passageway 534. In this embodiment, the method 800 also includes providing the pilot-operated main pressure relief valve 532 in the pressure relief passageway 534 such that the pilot-operated main pressure relief valve 532 is configured to operatively bleed fluid from the inlet port 422 to the drain port 521 via the pressure relief passageway 534 based on a pump supply pressure at the inlet port 422 exceeding a load pressure signal.

Various embodiments disclosed herein are to be taken in the illustrative and explanatory sense and should in no way be construed as limiting of the present disclosure. All joinder references (e.g., associated, provided, connected, coupled and the like) are only used to aid the reader's understanding of the present disclosure, and may not create limitations, particularly as to the position, orientation, or use of the control modules, the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", or any other ordinary and/or numerical terms, should also be taken only as identifiers, to assist the reader's understanding of the various elements of the present disclosure, and may not create any limitations, particularly as to the order, or preference, of any element relative to or over another element.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

With implementation of the embodiments disclosed herein, manufacturers of earthmoving machines can easily and quickly install the manifolds 300/600 for controlling movement of at least two hydraulic actuators of the machine. The manifolds of the present disclosure also helps manufacturers to reduce an amount of plumbing required to accomplish fluid transmission in a machine. Consequently, the manifolds also help manufacturers and users of earthmoving machines to increase value chain efficiency while reducing time, costs, and effort that was associated with installing and operating conventionally known fluid transmission setups that typically required extensive plumbing.

Moreover, with use of embodiments disclosed herein, a placement of components, for instance, the positioning of the inlet chamber 418 in parallel to the spool chamber 402, the locating of the spool actuators 452, 454 at one end of the manifold 300/600 and the positioning the spool actuators 452, 454 adjacently and in parallel to one another may render each of the manifolds 300/600 with a compact configuration, thereby helping manufacturers to install these manifolds 300/600 in locations that are typically associated with tight space constraints.

The bodies of individual control modules may be formed using metals, for example, ductile iron, brass, or a thermoplastic polymer, for example, High-density polyethylene (HDPE). The bodies of individual control modules may also be produced using commonly known processes including, but not limited to, die-casting, machining, additive manufacturing or other known to persons skilled in the art. Therefore, a manufacture of the bodies may be accomplished easily, quickly, and in a cost-effective manner. By using the housing to enclose the assembly of aforementioned components disclosed herein, the bodies of individual control modules may also help prevent deterioration of the components within when operating in extreme or harsh environments. Thus, the manifolds of the present disclosure also help to reduce downtimes previously associated with the machine, owing to frequent maintenance, repair or replacement of traditionally known fluid transmission setups that are exposed to similar working environments.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A control module for controlling operation of a hydraulic actuator associated with an earthmoving machine, the control module comprising:

a body having:

a spool chamber having a load sensing passageway associated therewith;

a spool positioned axially, and at least partially, within the spool chamber, the spool spring-biased by an end cap located at a first end of the body;

a pair of electrohydraulic spool actuators located at a second end of the body, the pair of spool actuators positioned in parallel and disposed adjacent to one another, wherein the pair of spool actuators are operable to axially displace the spool within the spool chamber;

a first outlet port and a second outlet port in selective and independent fluid communication with a spool supply passageway via the spool chamber, based on a position of the spool within the spool chamber;

an inlet chamber located parallel to the spool chamber and disposed in fluid communication with the spool chamber via the spool supply passageway, wherein the inlet chamber defines an inlet port and has, selectively disposed therein, one of:

a pressure compensating hydrostat having a valve member moveably positioned between a flow blocking position and a flow permitting position to fluid from the inlet port by a fluid pressure differential between the spool supply passageway and the load sensing passageway, the valve member biased by a first spring located between a first end of the valve member and a first plug disposed at an end port of the inlet chamber, or a load check valve axially biased towards a second end of the valve member by a second spring captured between a bearing surface of the load check valve and a second plug located at another end port of the inlet chamber, the other end port of the inlet chamber disposed in a direction opposite to the first end port of the inlet chamber;

a first port in fluid communication with the first outlet port via a first passageway, and comprising a third plug; and a second port in fluid communication with the second outlet port via a second passageway, and comprising a fourth plug.

2. The control module of claim 1, wherein:

the first port is in selective fluid communication with the spool chamber via a third passageway; and the second port is in selective fluid communication with the spool chamber via a fourth passageway.

3. The control module of claim 2, wherein the load sensing passageway is in selective and independent fluid communication with one of the third and fourth passageways.

4. The control module of claim 1 further comprising at least one of:

a first check valve, or a first pilot-operated relief valve disposed in the first port of the body.

5. The control module of claim 4 further comprising a second check valve disposed in the second port of the body.

6. The control module of claim 1 further comprising a first check valve disposed in the second port of the body.

7. The control module of claim 1 further comprising a drain port in selective fluid communication with:

the first port and the second port via a drain line; and the inlet port via a pressure relief passageway having a pilot-operated main pressure relief valve disposed therein, the pilot-operated main pressure relief valve configured to bleed fluid from the inlet port to the drain port via the pressure relief passageway based on a pump supply pressure at the inlet port exceeding a load pressure signal.

8. The control module of claim 1 further comprising: a first check valve and a first pilot-operated relief valve disposed in the first port of the body, and a second check valve disposed in the second port of the body.

9. A modular manifold for controlling operation of at least two hydraulic actuators associated with an earthmoving machine, the modular manifold comprising:

at least two control modules corresponding to the at least two hydraulic actuators, wherein the at least two control modules are adjacently located and coupled to one another in fluid communication, and wherein each control module includes:

a body having:

a spool chamber having a load sensing passageway associated therewith;

a spool positioned axially, and at least partially, within the spool chamber, the spool spring-biased by an end cap located at a first end of the body;

a pair of electrohydraulic spool actuators located at a second end of the body, the pair of spool actuators positioned in parallel and disposed adjacent to one another, wherein the pair of spool actuators are operable to axially displace the spool within the spool chamber;

a first outlet port and a second outlet port in selective and independent fluid communication with a spool supply passageway via the spool chamber, based on a position of the spool within the spool chamber;

a first port in fluid communication with the first outlet port via a first passageway;

a second port in fluid communication with the second outlet port via a second passageway;

an inlet chamber located parallel to the spool chamber and disposed in fluid communication with the spool chamber via the spool supply passageway, wherein the inlet chamber defines an inlet port and has, selectively disposed therein, one of:

a pressure compensating hydrostat having a valve member moveably positioned between a flow blocking position and a flow permitting position to fluid from the inlet port by a fluid pressure differential between the spool supply passageway and the load sensing passageway, the valve member biased by a first spring located between a first end of the valve member and a first plug disposed at an end port of the inlet chamber; and a load check valve axially biased towards a second end of the valve member by a second spring captured between a bearing surface of the load check valve and a second plug located at another end port of the inlet chamber, the other end port of the inlet chamber disposed in a direction opposite to the first end port of the inlet chamber; and a drain port in selective fluid communication with:

the first port and the second port via a drain line; and the inlet port via a pressure relief passageway having a pilot-operated main pressure relief valve disposed therein, the pilot-operated main pressure relief valve configured to bleed fluid from the inlet port to the drain port via the pressure relief passageway based on a pump supply pressure at the inlet port exceeding a load pressure signal.

10. The modular manifold of claim 9, wherein:

the first port is in selective fluid communication with the spool chamber via a third passageway; and the second port is in selective fluid communication with the spool chamber via a fourth passageway.

11. The modular manifold of claim 10, wherein the load sensing passageway is in selective and independent fluid communication with each of the third and fourth passageways.

12. The modular manifold of claim 9 further comprising at least one of:

a first check valve, a first pilot-operated relief valve, or a third plug disposed in the first port of the body.

13. The modular manifold of claim 12 further comprising a second check valve disposed in the second port of the body.

14. The modular manifold of claim 9 further comprising a first check valve, or a fourth plug disposed in the second port of the body.

15. The modular manifold of claim 9 further comprising a third plug disposed in the first port of the body and a fourth plug disposed in the second port of the body.

16. A method for controlling at least two hydraulic actuators of an earthmoving machine, the method comprising:

providing at least two control modules such that the at least two control modules have a pair of bodies located adjacent to one another;

defining, in each body:

a spool chamber having a load sensing passageway associated therewith;

an inlet chamber parallel to the spool chamber and in selective fluid communication with the spool chamber via a spool supply passageway;

providing, in each body:

a spool axially, and at least partially, positioned within the spool chamber;

an end cap at a first end of each body such that the end cap has a spring to bias the spool away from the end cap;

a pair of electrohydraulic spool actuators at a second end of each body such that the pair of spool actuators are positioned in parallel and disposed adjacent to one another; and defining, in each body:

an inlet port such that the inlet port is in fluid communication with the spool supply passageway, a first outlet port and a second outlet port such that the first and second outlet ports are in selective and independent fluid communication with the spool chamber based on a position of the spool within the spool chamber, a pilot supply port and a pilot discharge port in fluid communication with the pair of electrohydraulic spool actuators via a pilot supply line and a pilot discharge line respectively, and a drain port in selective fluid communication with:

the first port and the second port via a drain line, and the inlet port via a pressure relief passageway having a pilot-operated main pressure relief valve disposed therein, the pilot-operated main pressure relief valve configured to bleed fluid from the inlet port to the drain port via the pressure relief passageway based on a pump supply pressure at the inlet port exceeding a load pressure signal.

17. The method of claim 16 further comprising selectively providing, in the body of at least one control valve assembly, at least one of:

a pressure compensating hydrostat having a valve member biased by a first spring located between a first end of the valve member and a first plug disposed at an end port of the inlet chamber, the valve member moveably positioned between a flow blocking position and a flow permitting position to the inlet port by a fluid pressure differential between the spool supply passageway and the load sensing passageway; and a load check valve biased axially towards a second end of the valve member by a second spring captured between a bearing surface of the load check valve and a second plug located at another end port of the inlet chamber, the other end port of the inlet chamber disposed in a direction opposite to the end port of the inlet chamber.

18. The method of claim 17 further comprising defining, in each body:

a first port in fluid communication with the first outlet port via a first passageway and in selective fluid communication with the spool chamber via a third passageway; and a second port in fluid communication with the second outlet port via a second passageway and in selective fluid communication with the spool chamber via a fourth passageway, wherein the load sensing passageway is in selective and independent fluid communication with each of the third and fourth passageways.

* * * * *